US008061927B1

(12) United States Patent
Martinez

(10) Patent No.: US 8,061,927 B1
(45) Date of Patent: Nov. 22, 2011

(54) VEHICLE TRACKING PAD

(76) Inventor: Kevin L. Martinez, Denver, CO (US)

( * ) Notice: Subject to any disclaimer, the term of this patent is extended or adjusted under 35 U.S.C. 154(b) by 0 days.

(21) Appl. No.: 12/780,863

(22) Filed: May 14, 2010

(51) Int. Cl.
*E01C 5/16* (2006.01)

(52) U.S. Cl. ..... 404/15; 404/34; 404/36; 15/94

(58) Field of Classification Search ..... 404/34–38, 404/40–46, 15; 108/7; D6/582
See application file for complete search history.

(56) References Cited

U.S. PATENT DOCUMENTS

| | | | | |
|---|---|---|---|---|
| 1,720,461 | A * | 7/1929 | Barrett | 404/17 |
| 2,402,090 | A * | 6/1946 | Ruppel | 404/36 |
| 4,276,728 | A * | 7/1981 | Balzer et al. | 52/177 |
| 4,917,125 | A * | 4/1990 | Midkiff | 134/123 |
| 5,204,159 | A * | 4/1993 | Tan | 428/143 |
| 5,261,433 | A * | 11/1993 | Smith | 134/123 |
| 5,275,502 | A * | 1/1994 | Glaza et al. | 404/35 |
| 5,383,742 | A * | 1/1995 | Grace | 404/15 |
| 5,807,021 | A | 9/1998 | Aaron | |
| 6,561,201 | B1 * | 5/2003 | Midkiff | 134/104.4 |
| 6,695,527 | B2 | 2/2004 | Seaux et al. | |
| 6,802,159 | B1 * | 10/2004 | Kotler | 52/177 |
| 7,163,351 | B1 * | 1/2007 | Shaver | 404/15 |
| D560,946 | S * | 2/2008 | Malone | D6/582 |
| 7,775,739 | B1 * | 8/2010 | Lange | 404/15 |
| 2007/0258765 | A1 * | 11/2007 | Coyle et al. | 404/19 |
| 2007/0269264 | A1 * | 11/2007 | Boghossian | 404/19 |
| 2008/0095576 | A1 * | 4/2008 | Donald et al. | 404/34 |

OTHER PUBLICATIONS

Newpark Mats, Why Dura-Base Mats, brochure, unknown date, 1 page, Newpark Mats & Integrated Services.
Pathway Mats, Innovative Matting Solutions, unknown date, 1 page, Pathway Mats.

* cited by examiner

*Primary Examiner* — Raymond Addie
(74) *Attorney, Agent, or Firm* — Kyle W. Rost

(57) ABSTRACT

A component mat combines with similar mats to form a vehicle tracking pad assemblage, with juxtaposed ends joined by mechanical interlock. Optional turnout mats are interlocked to sides of the component mat. A top mat surface carries a finish formed of an array of upstanding mud removal elements of effective height. Mud removal element heights may be uniform among spaced apart elements or may vary among juxtaposed elements. The intermat interlock may carry the top finish to establish continuity over the junction. Suitable mud removal elements include cylinders, pyramids, ribs, and simulated rock patterns.

9 Claims, 6 Drawing Sheets

VEHICLE TRACKING PAD

BACKGROUND OF THE INVENTION

1. Field of the Invention

The invention generally relates to process or apparatus for road structure. More specifically, the invention relates to preformed modules or blocks of the portable mat type for pavement. Further, the invention relates to interfitting modules or blocks for pavement. A reusable mat provides a durable surface at tracking areas as typically found at construction sites. The mat configuration cleans the tires of trucks crossing the mat.

2. Description of Related Art Including Information Disclosed Under 37 CFR 1.97 and 1.98

Regulatory bodies frequently implement tracking control at construction sites. Tracking control is used to prevent or reduce off-site vehicle tracking from entering a storm drain or watercourse. A first type of tracking control is to provide stabilized construction approaches. A stabilized construction approach is a constriction site ingress/egress point that is stabilized to reduce the tracking of mud and dirt onto public roads by construction vehicles. This type of construction approach is utilized at sites where dirt or mud can be tracked onto public roads; where the site is adjacent to water bodies; where poor soils are encountered; and where dust is a problem during dry weather conditions.

Tracking control measures include a variety of standards and specifications, including but not limited to limiting points of ingress/egress; limiting vehicle speeds; properly grading each ingress/egress to prevent runoff onto paved roads; routing runoff through sediment traps; and designing stabilized ingress/egress points to support the heaviest equipment that will use it. A common specification requires a gravel pad at ingress/egress points. A filter fabric under liner often is required to line the bottom of the pad. In one location, a gravel pad specification calls for 1 inch rough diameter, clean, well graded gravel and crushed rock, commonly known as Class 150 Riprap Bedding. Another location requires coarser aggregate, such as two to three inch stone. Another system requires four to six inch rock. In different locations, specifications are known to require gravel pads to be twelve to twenty feet wide, six to eight inches deep, and fifty to seventy feet long and sometimes longer, yet. Standards further require continued re-screening, washing, or application of additional rock to maintain effectiveness. In practice, heavy construction trucks and equipment almost inevitably will press the gravel into the underlying mud, requiring that the gravel pad be reestablished by application of fresh bedding rock. Reestablishing the gravel pad may be required any number of times, according to need.

In addition to requiring stabilized entrances and exits with gravel pads, tracking control measures further include street sweeping to prevent sediment from leaving the site; dust control during working hours; and cleaning trackout from paved surfaces each day or each shift. Other specifications are known to require that all materials spilled, dropped, washed, or tracked from vehicles onto roadways or into storm drains must be removed immediately. In practice, the method of removal may require special street cleaning equipment or manual labor. Some methods of cleaning a highway, such as the use of water trucks to remove materials dropped, washed, or tracked onto roadways are prohibited under any circumstances.

Where gravel pads are not adequate to control trackout, regulations may require resort to a second type of tracking control: installation of wheel shakers, which are steel plates with ribs or corrugations extending across the entrance/exit. Typically wheel shakers are installed in the stabilized construction approach at the full width of the gravel pad over a substantial length, such as twenty-four feet. Of course, these wheel shakers must be manufactured and installed to support all expected loads. The addition of wheel shakers to a gravel pad adds both the basic cost of the additional features and the associated costs of operation, inspection, maintenance and repair.

Where tracking pads and wheel shakers are inadequate to control trackout, regulations may require resort to a third type of tracking control: wheel washers. The contractor may have to install a wash rack or wash station where the wheels and undercarriages of exiting vehicles are washed. Wheel wash stations can be located at stabilized construction egress points to remove sediment from tires and under-carriages, and to prevent dirt, mud, and other sediment from being transported onto public highways. The wheel wash station should be installed on level ground, on a grid or pad of coarse aggregate, with a drainage ditch leading to an approved settling area or sediment trapping device. Where a wash rack is built, it often must be constructed of reinforced concrete with transverse concrete ribs for permitting drainage. A drainage underpass is required where water might pool on one side of the wash rack structure. The wash rack, like all other portions of a construction approach, must be built to withstand anticipated traffic loads. The wash rack, ditch, and sediment trapping device require frequent inspection, sediment removal, and repair to maintain system performance. A maintenance specification may simply provide that the entrance must be maintained in a condition that will prevent tracking or flow of mud onto public rights-of-way.

In addition, tire wash stations require a supply of wash water. Where available, the contractor might obtain water from existing water service connections or fire hydrants. Where local water supply is not available, the contractor may have to bring in temporary water storage tanks. When a wash rack is installed, a turnout or doublewide exit is needed to avoid having entering vehicles drive through the wash area.

The variety of standards and specifications that have been described, above, are examples taken from known regulations but are not exhaustive of all such requirements. These regulations indicate the seriousness of the trackout problem. Contractors are in need of improved technology that prevents or adequately controls trackout from construction sites. When a tracking pad can adequately control trackout, then the contractor may avoid having to install additional tracking control devices such as wheel shakers and tire washers. Similarly, the contractor may avoid having to construct and maintain ditches and sediment trapping devices. However, regardless of which types of tracking control are needed, it would be desirable for the contractor to have a stabilized construction entrance that is both durable and effective to remove mud from equipment tires. Similarly, it would be desirable for the contractor to be able to recover at least some of the costs of building and maintaining a stabilized construction entrance/exit.

Mats are known for their ability to serve as load supporting, good traction surfaces. Interlocking mat systems are used to form temporary roadways and to provide large area coverage with improved traction over soft and uneven ground. U.S. Pat. No. 5,807,021 to Aaron shows a ground cover mat with a high traction surface on both faces, to interact with both the underlying ground and with vehicles traveling over the mat. U.S. Pat. No. 6,695,527 shows an interlocking mat system for construction of load supporting surfaces providing good traction. These surfaces can be used as temporary roadways and equipment support surfaces. A company known as Newpark Resources, Inc., currently on the Internet at www.Newpark-Mats.com, provides a mat system that can cover a wide area and provide a supporting work surface. A company known as Pathway Mats, Inc., currently on the Internet at www.pathwaymats.com, provides a mat system that forms a portable platform, walkway or roadway for outdoor and indoor events and construction sites. While these known mats and mat systems are designed to provide a stable surface with good traction, they do not address the problem of controlling trackout from construction sites. Therefore, a mat system that controls trackout is desirable, but it is not yet known.

To achieve the foregoing and other objects and in accordance with the purpose of the present invention, as embodied and broadly described herein, the method and apparatus of this invention may comprise the following.

BRIEF SUMMARY OF THE INVENTION

Against the described background, it is therefore a general object of the invention to provide a mat suited to control trackout from off-road sites onto paved roads.

According to the invention, a vehicle tracking pad controls trackout of mud from vehicle tires onto roadways from off-road sites. The tracking pad is formed of a mat body configured in a regular geometric shape of predetermined length, having top and bottom major faces, defining first and second opposite longitudinal end edges suited for mating with like mat bodies when arranged in series therewith to establish an egress path of greater length than the predetermined length, and formed of flexible material accommodating irregular ground surface. A finish on the top surface of the mat body defines a plurality of spaced apart, upstanding structures for removing mud from vehicle tires rolling over the upstanding structures. At least some of the upstanding structures have a height in the range from four to six inches.

The upstanding structures are selected from the group consisting of cylinders, pyramids, rock shapes, ribs, and combinations thereof. The upstanding structures are of predetermined thickness in the longitudinal direction of the mat and are longitudinally spaced apart by at least the dimension of the predetermined thickness of the upstanding structures.

The first and second opposite longitudinal end edges of the mat define a mechanical interlock. The mechanical interlock on the first end edge is an extending upper panel and the mechanical interlock on said second end edge is an extending lower panel. The upper panel and lower panel each are of a thickness less than one-half the thickness of the mat. The upper and lower panels are overlapped to establish the mechanical interlock. A bolt or other securing device is inserted through the upper and lower panels to secure the interlock.

According to a further aspect of the invention, a vehicle tracking pad is formed of first and second mat bodies. Each mat body is configured in a regular geometric shape of predetermined length, having top and bottom major faces defining first and second opposite longitudinal end edges carrying interlock elements for interlocking a first end of the first mat body with a second end of said second mat body when said first and second mat bodies are arranged in series, establishing an egress path of greater length than the predetermined length. The mats are formed of flexible material accommodating irregular ground surface. A finish on the top surface of each mat body defines a plurality of spaced apart, upstanding structures for removing mud from vehicle tires rolling over the upstanding structures. At least some of the upstanding structures have a height in the range from four to six inches.

The interlock elements define an overlap panel extending from a first end edge of each mat body and an underlap panel extending from a second, opposite end edge of each mat body. The overlap panels carry a portion of the finish on the top surface thereof for extending the finish between first and second mat bodies when interlocked with an overlap panel of one mat body overlapping the underlap panel of the other mat body.

Joined mats may form an egress path with a turnout. A turnout mat is arranged at a side edge of the first mat establishing the egress path. A mechanical interlock operates between the turnout mat and the first mat to maintain the turnout mat at the egress path.

The accompanying drawings, which are incorporated in and form a part of the specification, illustrate preferred embodiments of the present invention, and together with the description, serve to explain the principles of the invention. In the drawings:

DETAILED DESCRIPTION OF THE INVENTION

Figure 1:
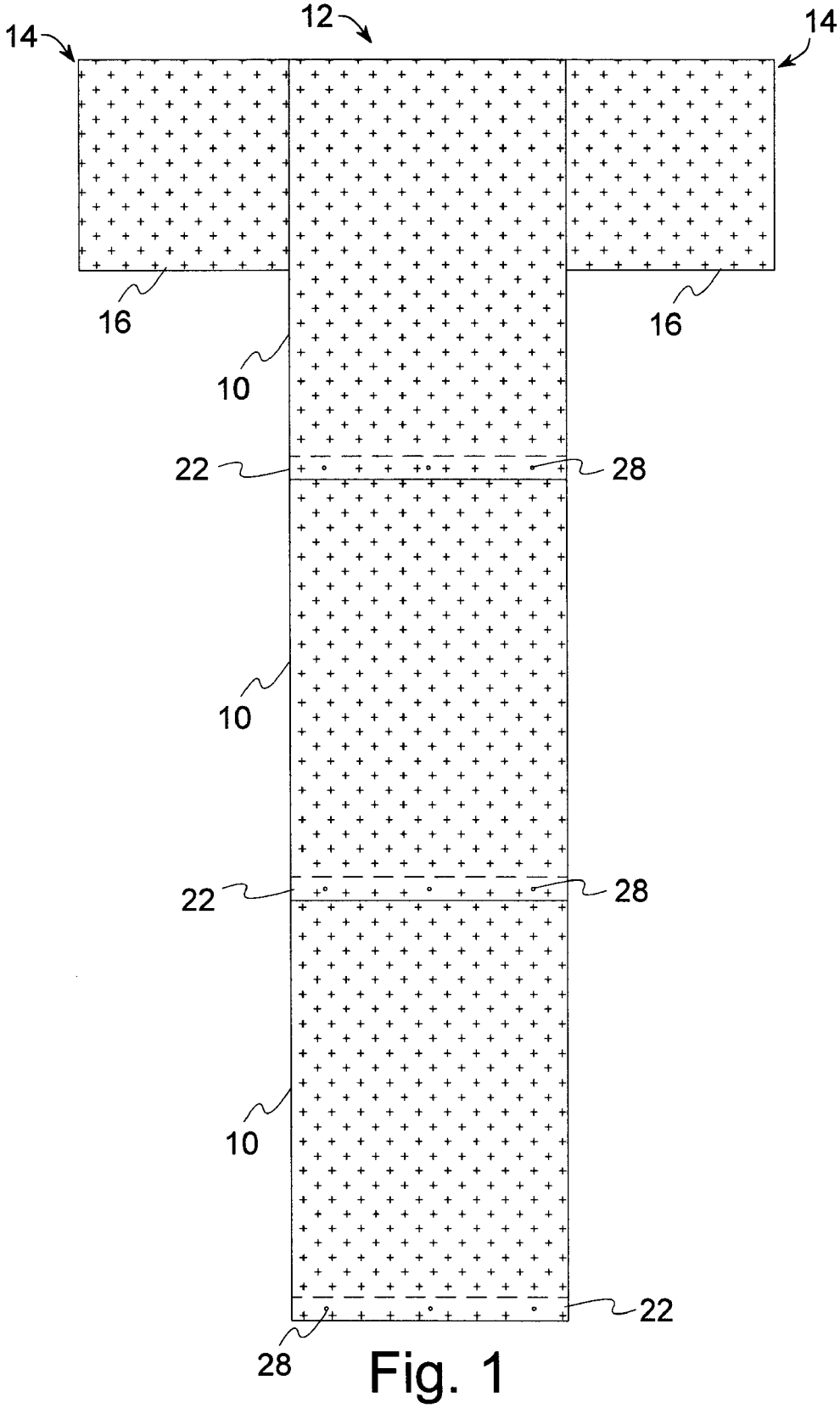
FIG. 1 is a top plan view of a typical layout of tracking mats assembled to form a tracking pad.

The invention is a mat 10 that serves as a component of a vehicle tracking pad assemblage. The mat 10 is able to serve as a sole pad and, in addition, is configured to define a component of a multi-unit assemblage of similar mats, together establishing a temporary, stabilized construction approach. Each mat is formed of a flexible material so that the mats are capable of following the contours of the underlying support, which may be bare ground. Thus, suitable materials for forming a mat 10 include rubber, elastomer, plastic, and reinforced varieties of rubber, elastomer, and plastic.

In the drawings, the same numbers will be applied to the same or substantially similar elements in all embodiments.

With reference to FIGS. 2, 5, 8, 11, and 14 of the drawings, a single vehicle tracking mat 10 is configured in a regular geometric shape such as a rectangle. In this context, a regular shape refers to a shape that fits together with other mats of similar shape to form a continuous surface. In addition to being of a regular shape, the mat 10 is scaled to conveniently combine with other similar mats 10 to define a construction approach 12, shown in FIG. 1. Thus, the width of a mat 10 may be approximately the width of a single lane construction approach 12 for ingress/egress. A mat width of seven to eight feet is suitable. The length of a mat 10 may be the greatest length that can be conveniently handled for installation. A mat length of twelve to fifteen feet is suitable.

Mats having the suggested dimensions can be combined both in length and in width. For example, a construction approach that is required to be twenty feet wide is easily established and slightly exceeded by three mats, each seven to eight feet wide, in side-by-side array. The mats can be assembled lengthwise to substantially any required length. Thus, a construction entrance that must be at least seventy feet long can be established and slightly exceeded by a series of six mats, each twelve feet long, assembled lengthwise.

Where a turnout 14 is required at a junction with a roadway, mats 10 can be laid, either transversely or longitudinally, at each side of the central path established by the mats. Where FIG. 1 shows a turnout 14 that is approximately six feet by six feet on each side of the central path, turnout mats 16 can be supplied, or the regular mats 10 can be cut as required to create these turnout mats 16 of slightly smaller configuration than the regular mats 10. Turnout mats 16 may carry elements of a mechanical interlock system at least at one end, for attachment to the main pathway of a construction approach 12. The mats 10 forming the main pathway of the construction approach 12 may carry mating elements of a mechanical interlock system on their side edges for mating with the turnout mats 16.

With reference to FIGS. 2-16, mat 10 is configured to clean mud from equipment tires passing over the mat. Each mat is formed of a main body 18 of predetermined thickness that may be termed "full thickness." The main body carries a working surface with a top side finish configured with mud removal structures for direct contact with equipment tires. The mud removal structures are characterized by a height and spacing that causes mud to be removed from vehicle tires rolling over the mud removal structures.

The main body 18 of mat 10 includes at least two opposite end edge panels, which typically will be the end edges at the longitudinal ends of a mat 10. The end edges carry means for mechanically interlocking two similar mats 10 arranged end-to-end. The longitudinal side edges of a mat 10 also may carry elements of a mechanical interlock system, as mentioned in reference to the use of turnout mats 16. The mechanical interlock can be an overlap and underlap system.

In an overlap and underlap system, one of the end edge panels 22, which can be called the underlap panel, extends beyond the main body 18 and working surface by a predetermined distance, such as one foot. The opposite end edge panel 24, which can be called the overlap panel, is topped by a portion of the working surface and extends from the main body 18 by a similar distance, such as one foot. The underlap end edge panel 22 is a low or bottom panel, and the overlap panel, which is the second and opposite end edge panel 24, is a high or top panel. The terms "low" and "high" refer to relative height positioning of the two panels 22,24 with respect to the full thickness of the main body 18. The low panel 22 may have about one-half the thickness or less of the full thickness of main body 18 and may extend from the bottom half of an edge of the main body 18. The high panel 24 may have about one-half the thickness or less of the full thickness of main body 18 and may extend from the top half of the opposite edge of the main body 18. In the described positions, the underlap and overlap system functions when the low panel of one mat 10 and the high end panel of another such mat 10 are overlapped when the two mats 10 meet and are suitably placed end-to-end.

As an example, the full thickness of the main body 18 may be four and one-quarter inches, while each of the panels 22, 24 may have a thickness of two inches. This example does not include the thickness of the contoured working surface, where it is carried on the top panel. Each panel 22, 24 in this example is less than one-half the full thickness of the main body 18, establishing a clearance of one-quarter inch when panels 22, 24 of two juxtaposed mats 10 are overlapped. This clearance is useful to ensure that an overlapping top panel 24 remains at no greater height than the top of the overlapped panel 22 of the juxtaposed mats 10. Thus, the top panel is less exposed to the tires of passing vehicles and is less prone to damage. The clearance also accommodates residual mud between the overlapped panels.

The overlapping panels 22, 24 form an interlock that is helpful for establishing an assemblage, as contrasted to an array of mats merely placed in spatial proximity to one another. Another element of the interlock is a mechanical through-fastener that secures the overlapped panels in fixed relative positions. A fastener can be a bolt 26 passing through both panels. The top panel 24 and bottom panel 22 may define a plurality of bolt holes 28 positioned to be in alignment when panels of linearly arranged mats 10 overlap. The bolt holes in the bottom panels 22 may include built-in nuts or the like to engage with bolts 26 inserted through top panels 24.

Figure 2:
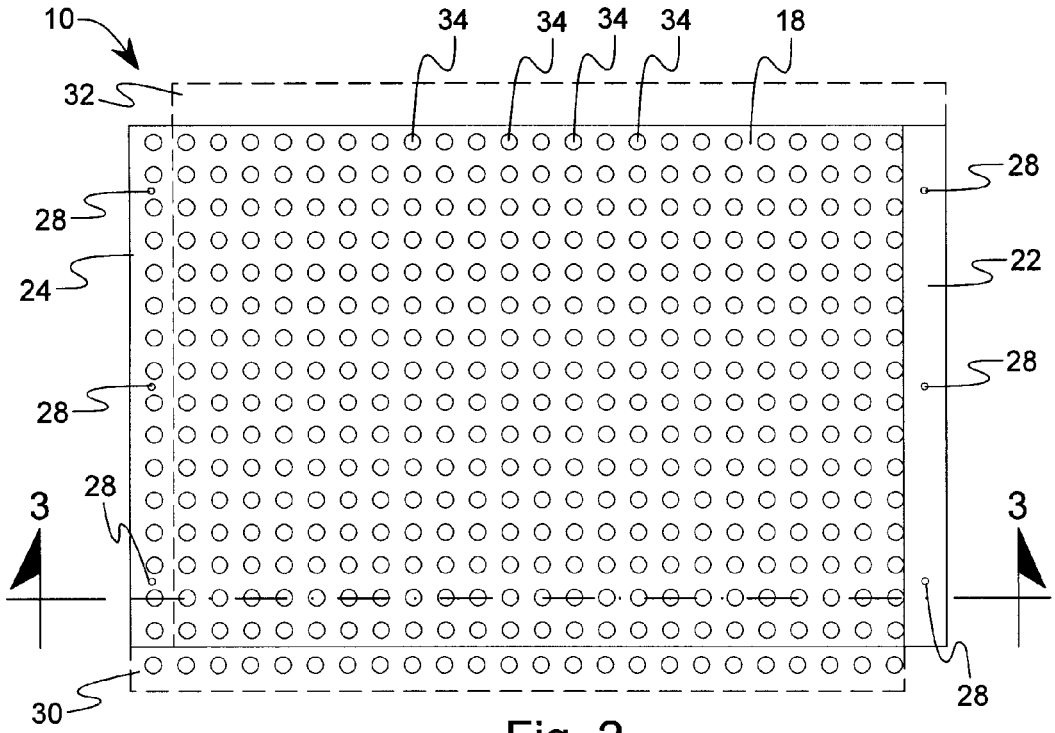
FIG. 2 is a top plan view of a vehicle tracking mat according to a first embodiment of the present invention employing cylinders as mud removing elements, and showing optional lateral edge panels in phantom.

The interlockable edge panels are primarily desirable on the longitudinal ends of a mat 10, with the mat arranged for vehicle traffic to follow the longitudinal dimension of the mat. With reference to FIG. 2, an optional, similar arrangement may provide a high panel 30 and low panel 32 formed at the opposite lateral edges of a mat 10. Lateral high and low panels 30, 32 are useful for interlocking parallel rows of longitudinally aligned mats 10 or for forming a wide row of laterally aligned panels 10. The top panel 30 may carry a portion of the contoured working surface, while the bottom panel 32 typically would not. The lateral panels 30,32 are optional additions to any embodiment of the invention, regardless of surface finish.

Figure 3:
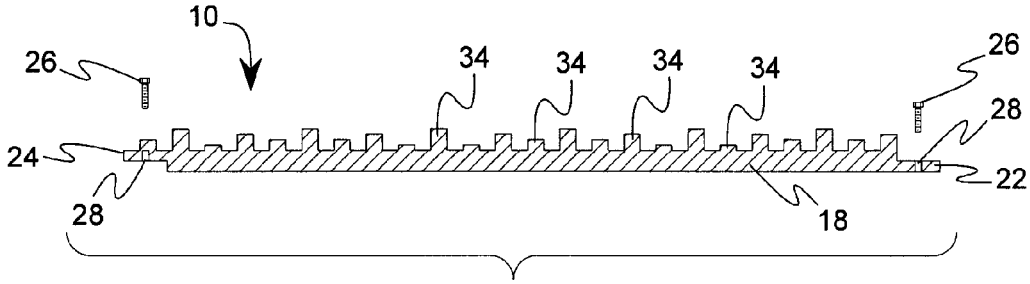
FIG. 3 is a cross-sectional view taken at the plane of line 3-3 in FIG. 2 and showing bolts in assembly positions.
Figure 4:
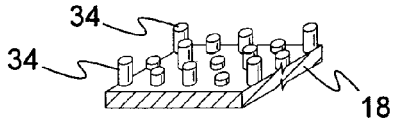
FIG. 4 is a fragmentary isometric view of the first embodiment, showing the pattern of surface structures.

The working surface is contoured with a configuration of structures serving as a means for removing mud from tires of passing trucks and other equipment. With reference to FIGS. 2-16, the working surface is a top finish formed of an array of upstanding mud removing elements. In a first embodiment of the top finish illustrated in FIGS. 2-4, the mud removing elements are upstanding cylinders 34. As best shown in FIGS. 3 and 4, the mud removing elements may be of varying heights. For example and not as a limitation, the mud removing elements may be varied in four heights, with an incremental increase from the shortest to the tallest. In particular, FIG.

3 shows a longitudinal row of mud removing elements with heights varying in relative dimensions rated from 1-4. The illustrated sequence is 4-1-3-2-4-2-3-1-, which then repeats over the length of the row. This illustrated sequence can be termed a random sequence with the tallest elements separated by one or more shorter elements. Neighboring rows can be longitudinally shifted or otherwise varied from the illustrated sequence.

Figure 8:
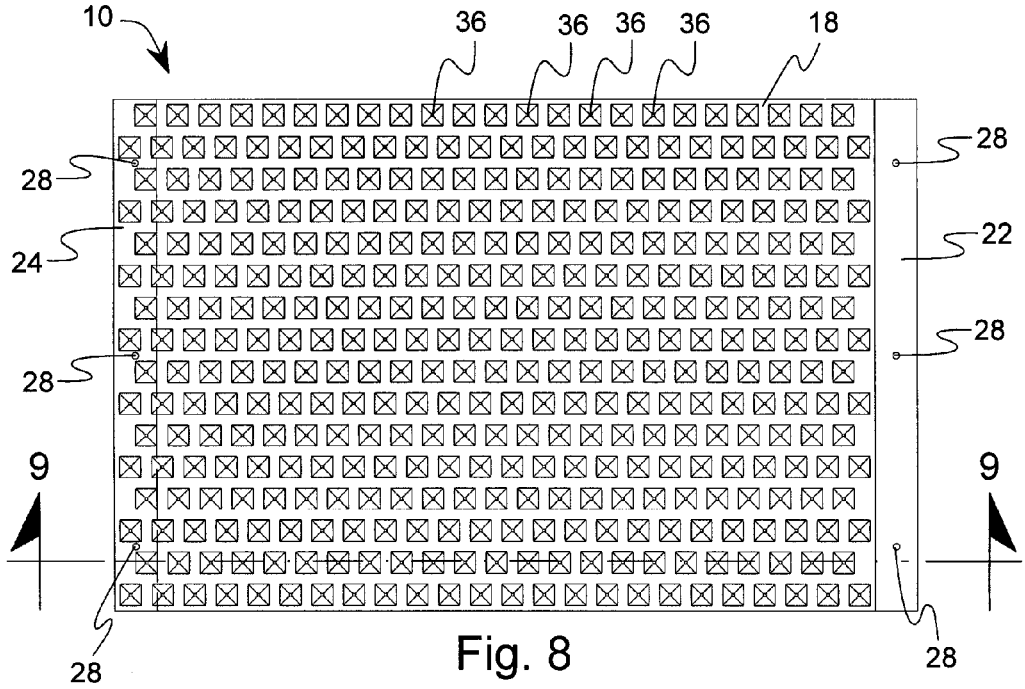
FIG. 8 is a top plan view of a vehicle tracking mat according to a third embodiment of the present invention employing pyramids in a staggered configuration as mud removing elements.

FIG. 4 shows shifted row patterns such that transverse rows show random height variations. The transverse row variations may be similar to those of the longitudinal rows. Some of the illustrated transverse rows show sequences such as 4-1-4-, 2-4-2-, 3-1-3-, 1-3-1-, and 4-2-4-. Where the mud removing elements are cylinders 34, the cylinders can be separated from one another both longitudinally and laterally. The distance of separation is greater than the diameter of each cylinder. The typical heights of each cylinder may be in the range from two to six inches with diameters of three to six inches, measured from the top face of the mat body 18.

Where the mud removing elements are configured as discrete members suitable for arrangement into longitudinal and transverse rows, various row arrangements are suitable. The longitudinal and transverse rows can be perpendicular to one another, as suggested by the arrangement of cylinders in FIG. 2. An optional arrangement shown in FIG. 8 employs staggered neighboring rows such that a mud removing element in a second row is offset from transverse alignment with such elements in a first row. Rows may extend diagonally or at other non-square angles to the shape of a mat 10. The staggered arrangement may be symmetrical, with the elements of one row near the middle of the distance between juxtaposed elements of the neighboring row, as shown in FIG. 8. A staggered arrangement also may be nonsymmetrical. The mud removing elements also can be arranged in arbitrary patterns, such as where the elements simulate stones or aggregate.

Figure 5:
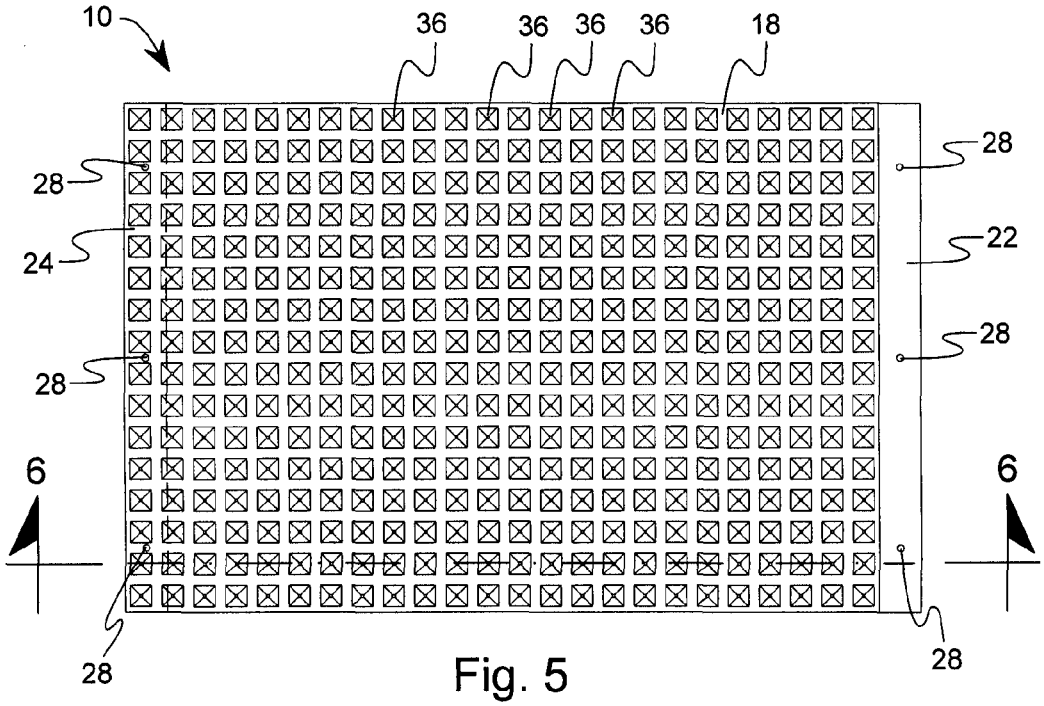
FIG. 5 is a top plan view of a vehicle tracking mat according to a second embodiment of the present invention employing pyramids in a square configuration as mud removing elements.
Figure 6:
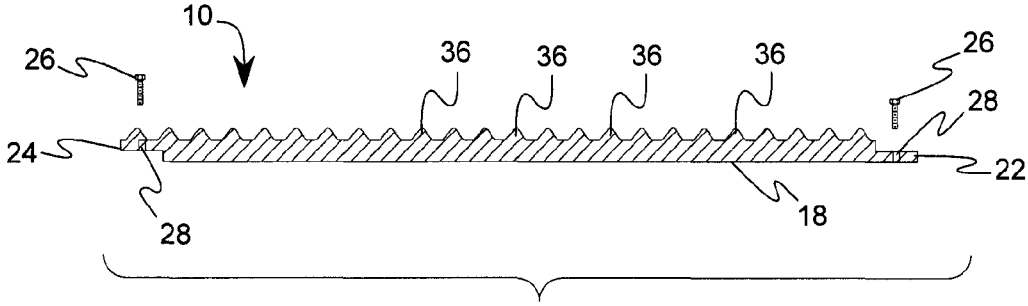
FIG. 6 is a cross-sectional view taken at the plane of line 6-6 in FIG. 5, and showing bolts in assembly positions.
Figure 7:
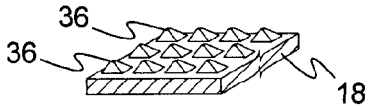
FIG. 7 is a fragmentary isometric view of the second embodiment, showing the pattern of surface structures.

In a second illustrated embodiment of the top finish shown in FIGS. 5-7, the mud removing elements are pyramid shaped structures 36 in a square pattern of transverse and longitudinal rows and columns. The heights of the pyramids are selected for effectiveness in removing mud from vehicle tires. Heights in the approximate range from four to six inches are suitable. All pyramids may be of the same height, such as six inches, or the heights of successive pyramids in a row or series may be varied, as suggested by the disclosed sequences of heights for cylinders 34.

Figure 9:
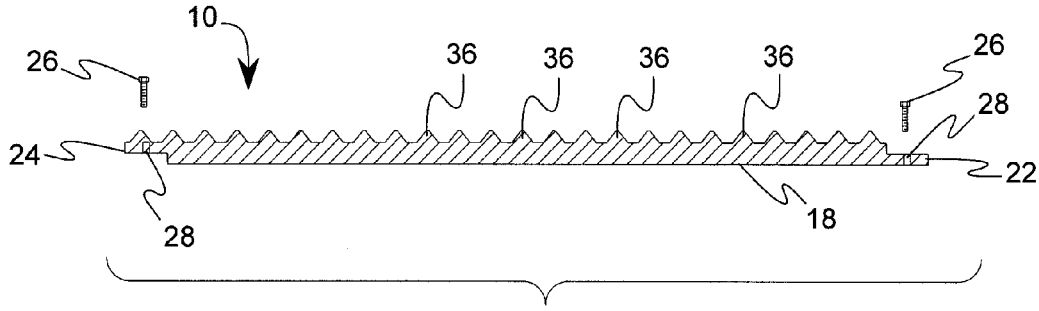
FIG. 9 is a cross-sectional view taken at the plane of line 9-9 in FIG. 8 and showing bolts in assembly positions.
Figure 10:
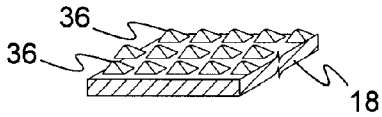
FIG. 10 is a fragmentary isometric view of the third embodiment, showing the pattern of surface structures.

In a third illustrated embodiment of the top finish shown in FIGS. 8-10, the mud removing elements are pyramid shaped structures 36 in a staggered pattern. While the drawings illustrate a regular or symmetrical staggered pattern, an alternative arrangement might be nonsymmetrical or irregular.

Figure 11:
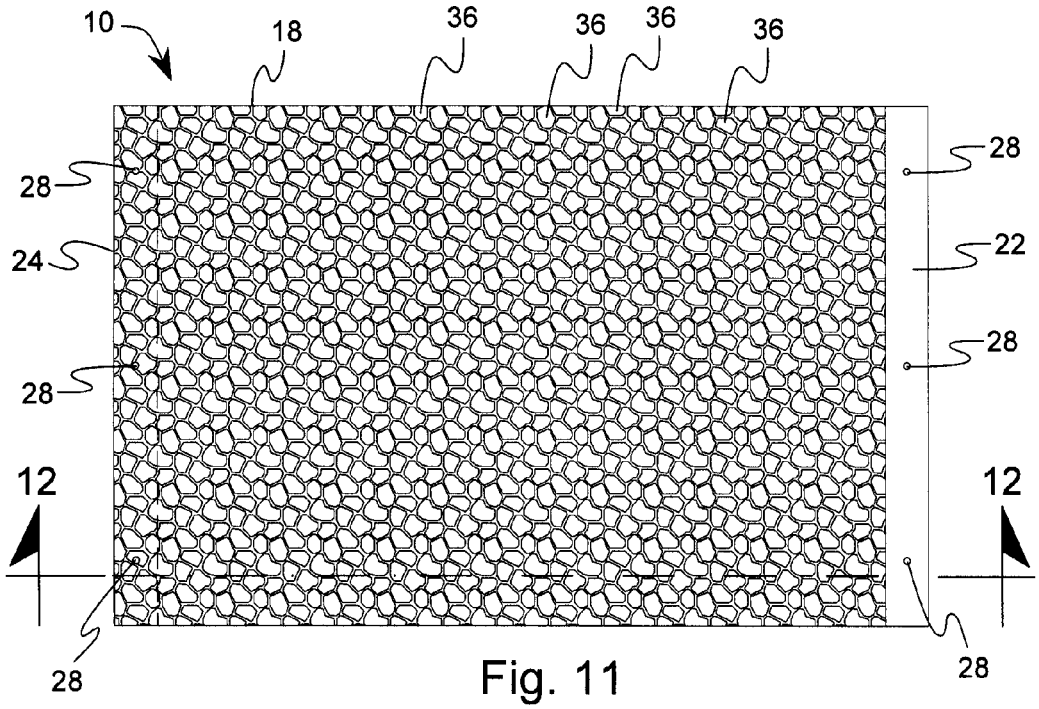
FIG. 11 is a top plan view of a vehicle tracking mat according to a fourth embodiment of the present invention employing a simulated aggregate configuration as mud removing elements.
Figure 12:
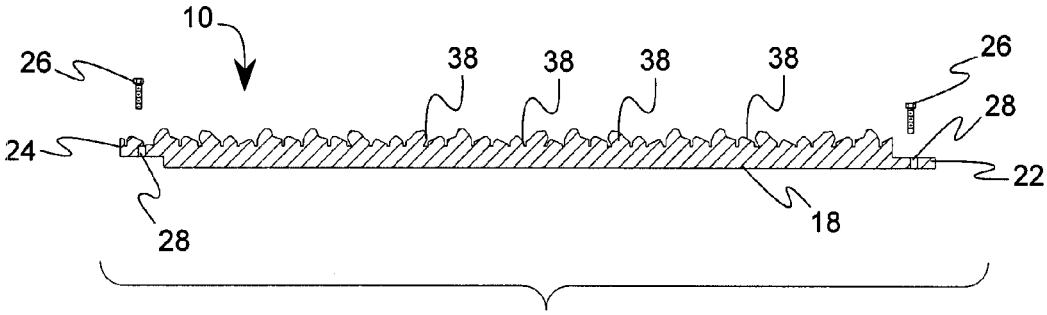
FIG. 12 is a cross-sectional view taken at the plane of line 12-12 in FIG. 11, and showing bolts in assembly positions.
Figure 13:
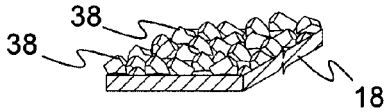
FIG. 13 is a fragmentary isometric view of the fourth embodiment, showing the pattern of surface structures.

In a fourth illustrated embodiment of the top finish, the mud removing elements are simulated rock or aggregate shaped structures 38 as shown in FIGS. 11-13. An aggregate pattern can be irregular and nonsymmetrical, as would be the case with real aggregate; although as a practical matter, a molded aggregate pattern would be expected to repeat certain portions of the pattern. An arrangement that is regular and symmetrical is acceptable. The height of the aggregate finish is arranged for effectiveness in removing mud from vehicle tires. Suitable heights for the simulated aggregate elements are in the approximate range of from four to six inches. As described for the cylinder finish, the heights of the aggregate elements may range over other heights, as well. The feature of arranging the mud removing elements in square or staggered pattern can be employed not only for pyramid shaped structures 36 but also for cylinders 34 and aggregate 38.

Figure 14:
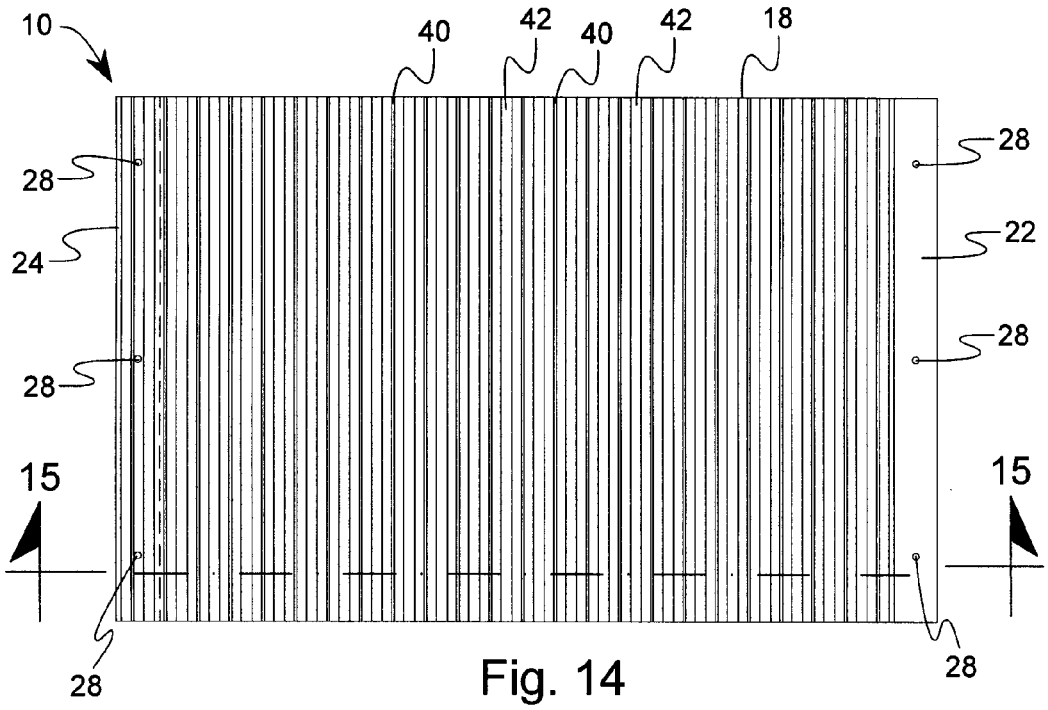
FIG. 14 is a top plan view of a vehicle tracking mat according to a fifth embodiment of the present invention employing a configuration of transverse ribs and grooves as mud removing elements.
Figure 15:
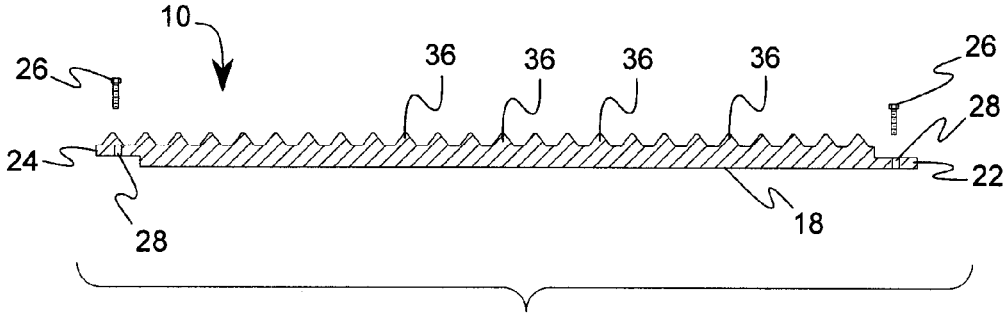
FIG. 15 is a cross-sectional view taken at the plane of line 15-15 in FIG. 14, and showing bolts in assembly positions.
Figure 16:
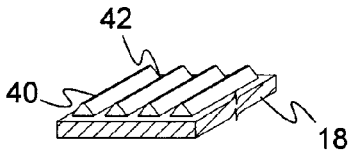
FIG. 16 is a fragmentary isometric view of the fifth embodiment, showing the pattern of surface structures.

In a fifth illustrated embodiment of the top finish, the mud removing elements are transverse ribs 40 and grooves 42 as shown in FIGS. 14-16. The ribs may taper upwardly to an apex. A spacing between juxtaposed ribs 40 establishes each groove 42. The spacing may be approximately one-half the thickness of a rib. The height of the ribs is selected for effectiveness as mud removing elements, with a suitable height being in the approximate range from four to six inches.

Regardless of pattern, the mud removing elements of each type are spaced apart and present height variations sufficient that the elements act against tires rolling over the mat 10 to cause mud to be removed from the tires. One of the chief mechanisms from removing mud from tires is to deform the tires as they pass over the mud removing elements. Where the mud removing elements are of different heights, the variation should be frequent enough to locally deform a tire. The height variations shown in FIG. 3 provide guidance, showing approximately two mud removing elements and two gaps per foot. If the two mud removing elements are unequal in height, a taller element and a shorter element are arranged in spaced, longitudinal series. Each element of FIG. 3 is spaced apart from the next in longitudinal series by a gap distance similar to the thickness of a mud removing element.

Similarly, where the pyramids of FIGS. 6 and 9 are of uniform height, the distance between pyramids in series is a significant factor for deforming tires. The distance between the apexes of pyramids in series is similar to or greater than the thickness of a pyramid element. Viewed in longitudinal series, approximately two pyramids and two gaps define each foot. The staggering between two longitudinal rows influences the lateral deformation induced in a tire.

Mud removing elements with a configuration simulating aggregate function similarly to cylinders and pyramids. The randomness of an aggregate pattern presents a varied series of high and low mud removing elements, coupled with varied lateral heights.

Ribs and grooves can be sized and spaced similarly to pyramids. The uniformity of a rib that extends transversely across a mat induces an additional shaking effect.

It is possible for a mat to carry more than one type of finish. Thus, cylinders, pyramids, irregular rock shapes, and ribs can be integrated into the finish of a single mat.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

What is claimed is:

1. A vehicle tracking pad for controlling trackout of mud from vehicle tires onto roadways from off-road sites, comprising:

a mat body configured in a regular geometric shape of predetermined length, having top and bottom major faces, defining first and second opposite longitudinal end edges suited for mating with like mat bodies when arranged in series therewith to establish an egress path of greater length than said predetermined length, and formed of flexible material accommodating irregular ground surface; and a finish on said top surface of said mat body defining a plurality of laterally and longitudinally localized, spaced apart, upstanding structures configured to locally deform a tire for removing mud from vehicle tires rolling over said upstanding structures, wherein at least some of said upstanding structures have a height in the range from four to six inches.

2. The vehicle tracking pad of claim 1, wherein said upstanding structures are of various different heights.

3. The vehicle tracking pad of claim 1, wherein:

said upstanding structures are selected from the group consisting of cylinders, pyramids, rock shapes, and combinations thereof.

4. The vehicle tracking pad of claim 1, wherein:

said upstanding structures are of predetermined thickness in the longitudinal direction and are longitudinally spaced apart by at least the dimension of said predetermined thickness.

5. The vehicle tracking pad of claim 1, wherein:

said first and second opposite longitudinal end edges define a mechanical interlock.

6. The vehicle tracking pad of claim 5, wherein:

said mechanical interlock on said first end edge is an extending upper panel and said mechanical interlock on said second end edge is an extending lower panel, wherein said upper panel and lower panels are configured to engages one another in an underlap and overlap relationship and each is of a thickness less than one-half the thickness of said mat body.

7. A vehicle tracking pad for controlling trackout of mud from vehicle tires onto roadways from off-road sites, comprising:

first and second mat bodies, each configured in a regular geometric shape of predetermined length, having top and bottom major faces defining first and second opposite longitudinal end edges carrying interlock elements for interlocking a first end of said first mat body with a second end of said second mat body when said first and second mat bodies are arranged in series, establishing an egress path of greater length than said predetermined length, and formed of flexible material accommodating irregular ground surface;

a finish on said top surface of each mat body defining a plurality of laterally and longitudinally localized, spaced apart, upstanding structures configured to locally deform a tire for removing mud from vehicle tires rolling over said upstanding structures, wherein at least some of said upstanding structures have a height in the range from four to six inches.

8. The vehicle tracking pad of claim 7, wherein said interlock elements comprise:

an overlap panel extending from said first end edge of each mat body;

an underlap panel extending from said second end edge of each mat body; and said overlap panels carry a portion of said finish on the top surface thereof for extending the finish between said first and second mat bodies when interlocked with an overlap panel of one mat body overlapping the underlap panel of the other mat body.

9. The vehicle tracking pad of claim 7, further comprising:

a turnout mat arranged at a side edge of said first mat establishing said egress path; and a mechanical interlock between said turnout mat and said first mat.

* * * * *